US008361256B2

(12) United States Patent
Arai et al.

(10) Patent No.: US 8,361,256 B2
(45) **Date of Patent: *Jan. 29, 2013**

(54) METHOD FOR PRODUCING SEAMLESS STEEL PIPE

(75) Inventors: Yuji Arai, Amagasaki (JP); Keiichi Nakamura, Wakayama (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 194 days.

This patent is subject to a terminal disclaimer.

(21) Appl. No.: 12/010,433

(22) Filed: Jan. 24, 2008

(65) Prior Publication Data

US 2008/0121318 A1 May 29, 2008

Related U.S. Application Data

(63) Continuation of application No. PCT/JP2006/314630, filed on Jul. 25, 2006.

(30) Foreign Application Priority Data

Jul. 25, 2005 (JP) ..... 2005-214723

(51) Int. Cl.
*C21D 9/08* (2006.01)
*C22C 38/00* (2006.01)
*C22C 38/22* (2006.01)

(52) U.S. Cl. ..... 148/593; 148/330; 148/333; 148/334

(58) Field of Classification Search ..... 148/330, 148/593, 333, 334; 420/104–106, 110, 111
See application file for complete search history.

(56) References Cited

U.S. PATENT DOCUMENTS

| | | | | |
|---|---|---|---|---|
| 4,075,041 | A * | 2/1978 | Ueno et al. | 148/593 |
| 5,938,865 | A | 8/1999 | Kondo et al. | |

FOREIGN PATENT DOCUMENTS

| | | | |
|---|---|---|---|
| CN | 1064276 | C | 4/2001 |
| EP | 828007 | A1 * | 3/1998 |
| EP | 1 008 660 | | 6/2000 |
| EP | 1 712 651 | | 10/2006 |
| JP | 4-232209 | | 8/1992 |
| JP | 04232209 | A * | 8/1992 |
| JP | 05-271772 | | 10/1993 |
| JP | 6-172859 | | 6/1994 |
| JP | 6-220536 | | 8/1994 |
| JP | 07-197125 | | 8/1995 |
| JP | 08-311551 | | 11/1996 |
| JP | 11-302785 | | 11/1999 |
| JP | 2000-219914 | | 8/2000 |
| JP | 2001-011568 | | 1/2001 |
| JP | 2001-140032 | | 5/2001 |
| JP | 2001-262275 | | 9/2001 |
| JP | 2004-124158 | | 4/2004 |
| JP | 2005-232539 | | 9/2005 |
| JP | 2005-298900 | | 10/2005 |
| RU | 2 070 585 | | 12/1996 |
| RU | 2 210 604 | | 8/2003 |
| WO | 96/12574 | | 5/1996 |

OTHER PUBLICATIONS

Yagi et al., English translation of JP 04-232209, Aug. 1992.*
J. M. Hodge, et al., "Relationship Between Hardenability and Percentage Martensite in Some Low-Alloy Steels", Trans. AIME, 167(1946), pp. 627-642.

* cited by examiner

*Primary Examiner* — Roy King
*Assistant Examiner* — Caitlin Kiechle
(74) *Attorney, Agent, or Firm* — Clark & Brody

(57) ABSTRACT

A seamless steel pipe produced by heating a steel billet, which has a chemical composition C: 0.15 to 0.20%, Si: not less than 0.01% to less than 0.15%, Mn: 0.05 to 1.0%, Cr: 0.05 to 1.5%, Mo: 0.05 to 1.0%, Al≦0.10%, V: 0.01 to 0.2%, Ti: 0.002 to 0.03%, B: 0.0003 to 0.005% and N: 0.002 to 0.01%, further optionally one or more of Ca, Mg and REM in a specific amount, under the provision that the conditions "C+(Mn/6)+(Cr/5)+(Mo/3)≧0.43" and "Ti×N<0.0002−0.0006×Si" are satisfied, with the balance being Fe and impurities, wherein P≦0.025%, S≦0.010% and Nb<0.005% among the impurities, to a temperature of 1000 to 1250° C. followed by pipe-making rolling at a final rolling temperature 900 to 1050° C., and then quenching the resulting steel pipe directly from a temperature not lower than the $Ar_3$ transformation point followed by tempering at a temperature range from 600° C. to the $Ac_1$ transformation point, or instead of the above after the said pipe-making rolling, complementarily heating the resulting steel pipe in a temperature range from the $Ac_3$ transformation point to 1000° C. in-line, and then quenching it from a temperature not lower than the $Ar_3$ transformation point followed by tempering at a temperature range from 600° C. to the $Ac_1$ transformation point, has high strength and excellent toughness and at the same time has a high yield ratio and is excellent in SSC resistance as well.

2 Claims, No Drawings

METHOD FOR PRODUCING SEAMLESS STEEL PIPE

This application is a continuation of the international application PCT/JP2006/314630 filed on Jul. 25, 2006, the entire content of which is herein incorporated by reference.

TECHNICAL FIELD

The present invention relates to a method for producing a seamless steel pipe. More specifically, the present invention relates to a method for producing a seamless steel pipe, having a high yield strength (YS) of not less than 759 MPa together with a high yield ratio and being excellent in toughness and sulfide stress cracking resistance, by a low-cost in-line quenching process.

BACKGROUND ART

A seamless steel pipe, which is more reliable than a welded pipe is frequently used in a severe oil well or gas well (hereinafter collectively referred to as "oil well") environment or in high temperature environment, and the enhancement of strength, improvement of toughness and improvement in sour resistance are therefore consistently required. Particularly, in oil wells to be developed in the future, the enhancement in strength and improvement in toughness of the steel pipe are needed more than ever before because a high-depth well will become the mainstream, and a seamless steel pipe also having sulfide stress cracking resistance (hereinafter "SSC resistance" for short) is increasingly required because the pipe is used in a severe corrosive environment.

The hardness, namely the dislocation density, of a steel product rises as the strength is enhanced, and the amount of hydrogen which penetrates into the steel product increases to make the steel product fragile to stress because of the high dislocation density. Accordingly, the SSC resistance generally deteriorates against the enhancement in the strength of the steel product which is used in a hydrogen sulfide-rich environment. Particularly, when a member which has the desired yield strength is produced by use of a steel product with a low ratio of "yield strength/tensile strength" (hereinafter referred to as yield ratio), the tensile strength and hardness are apt to increase, and the SSC resistance remarkably deteriorates. Therefore, when the strength of the steel product is raised, it is important to increase the yield ratio in order to keep the hardness low.

Although it is preferable to make the steel product into a uniform tempered martensitic microstructure in order to increase the yield ratio, that alone is not sufficient. One method for further enhancing the yield ratio in the tempered martensitic microstructure is the refinement of prior-austenite grains (hereinafter referred to merely as "austenite grains"). The said refinement of austenite grains is also effective in increasing the toughness of a high strength steel product.

However, the refinement of austenite grains needs an off-line quenching treatment, which deteriorates the production efficiency and increases the energy used. Therefore, currently this method is disadvantageous due to the rationalization of cost, improvement in production efficiency and energy saving which are all indispensable to manufacturers.

Thus, some technologies for the refinement of austenite grains by adding Nb, in a production process including a highly productive in-line quenching treatment, are disclosed in the Patent Documents 1 to 3. Further, a technology for the refinement of austenite grains by controlling the contents of N and Nb, in a production process including an in-line quenching treatment, is disclosed in the Patent Document 4.

Patent Document 1: Japanese Laid-open Patent Publication No. 05-271772,

Patent Document 2: Japanese Laid-open Patent Publication No. 08-311551,

Patent Document 3: Japanese Laid-open Patent Publication No. 2000-219914

Patent Document 4: Japanese Laid-open Patent Publication No. 2001-11568

DISCLOSURE OF THE INVENTION

Problems to be Solved by the Invention

The technologies disclosed in the above-mentioned Patent Document 1 and 2 comprise causing Nb carbonitrides to finely precipitate during hot rolling and reheating prior to a direct quenching, in order to refine the austenite grains by utilizing the pinning effect thereof. However, the solubility of Nb in a steel highly depends on a temperature in the range of 800 to 1100° C. Accordingly, slight temperature differences result in variations in the amount of precipitated Nb carbonitrides. Therefore, when the temperature varies in the steel pipe during the pipe-making process by hot working, austenite grains produce mixed grain structures due to the variation in the amount of precipitated Nb carbonitrides. In addition, the variations in the amount of dissolved Nb in a direct quenching lead to variations in the amount of the newly precipitated fine Nb carbonitrides in the tempering treatment, which is the final heat treatment, hence to variations in the degree of precipitation hardening and also to variations in the strength in the inside of the steel pipe; as a result, no reliable steel pipes can be obtained. Thus, in the case of manufacturing a steel pipe, which has high strength and excellent SSC resistance by an in-line quenching treatment, the addition of Nb is unfavorable.

On the other hand, the technology disclosed in the Patent Document 3 restricts the Nb content to a low level, within the range of 0.005 to 0.012%, in order to obtain dissolved Nb in the in-line quenching treatment and thereby reduce variations in strength. However, the dissolved Nb precipitates as very fine Nb carbonitrides in the tempering step and this contributes to precipitation hardening, and thus, the influence of the Nb content on the strength substantially increases, so that variations in the Nb content result in variations in strength. Therefore, it becomes necessary to vary the tempering temperature according to variations in Nb content in the steel; thus the technology is uneconomical.

According to the technology disclosed in the Patent Document 4, a steel pipe slight in strength variation and excellent in SSC resistance can be produced by carrying out an in-line quenching treatment. However, as shown in the example section, the restrictions on the contents of C, Cr, Mn and Mo are insufficient, so that the steel pipes obtained are low in yield ratio. Therefore, only steel pipes which have a yield strength lower than 759 MPa (110 ksi) can acquire the excellent SSC resistance.

Accordingly, it is the objective of the present invention to provide a method for producing a seamless steel pipe, having a high strength and excellent toughness and, in addition, having a high yield ratio and excellent SSC resistance, by an efficient means which is capable of realizing energy savings.

Means for Solving the Problems

The gists of the present invention are methods for producing seamless steel pipes shown in the following (1) and (2).

(1) A method for producing a seamless steel pipe, which comprises the steps of making a pipe by heating a steel billet, which has a chemical composition on the mass percent basis, C: 0.15 to 0.20%, Si: not less than 0.01% to less than 0.15%, Mn: 0.05 to 1.0%, Cr: 0.05 to 1.5%, Mo: 0.05 to 1.0%, Al: not more than 0.10%, V: 0.01 to 0.2%, Ti: 0.002 to 0.03%, B: 0.0003 to 0.005% and N: 0.002 to 0.01%, under the provision that the following formulas (1) and (2) are satisfied, with the balance being Fe and impurities, wherein the content of P is not more than 0.025%, the content of S is not more than 0.010% and the content of Nb is less than 0.005% among the impurities, to a temperature of 1000 to 1250° C. followed by pipe-making rolling at a final rolling temperature adjusted to 900 to 1050° C., and then quenching the resulting steel pipe directly from a temperature not lower than the $Ar_3$ transformation point followed by tempering at a temperature range from 600° C. to the $Ac_1$ transformation point, or instead of the above after the said pipe-making rolling, complementarily heating the resulting steel pipe in a temperature range from the $Ac_3$ transformation point to 1000° C. in-line, and then quenching it from a temperature not lower than the $Ar_3$ transformation point followed by tempering at a temperature range from 600° C. to the $Ac_1$ transformation point:

$$C+(Mn/6)+(Cr/5)+(Mo/3)\geqq 0.43 \quad (1),$$

$$Ti\times N<0.0002-0.0006\times Si \quad (2),$$

wherein C, Mn, Cr, Mo, Ti, N and Si in the above formulas (1) and (2) represent the mass percent of the respective elements.

(2) A method for producing a seamless steel pipe, which comprises the steps of making a pipe by heating a steel billet, which has a chemical composition on the mass percent basis, C: 0.15 to 0.20%, Si: not less than 0.01% to less than 0.15%, Mn: 0.05 to 1.0%, Cr: 0.05 to 1.5%, Mo: 0.05 to 1.0%, Al: not more than 0.10%, V: 0.01 to 0.2%, Ti: 0.002 to 0.03%, B: 0.0003 to 0.005% and N: 0.002 to 0.01% and, further, one or more elements selected from among Ca: 0.0003 to 0.01%, Mg: 0.0003 to 0.01% and REM: 0.0003 to 0.01%, under the provision that the following formulas (1) and (2) are satisfied, with the balance being Fe and impurities, wherein the content of P is not more than 0.025%, the content of S is not more than 0.010% and the content of Nb is less than 0.005% among the impurities, to a temperature of 1000 to 1250° C. followed by pipe-making rolling at a final rolling temperature adjusted to 900 to 1050° C., and then quenching the resulting steel pipe directly from a temperature not lower than the $Ar_3$ transformation point followed by tempering at a temperature range from 600° C. to the $Ac_1$ transformation point, or instead of the above after the said pipe-making rolling, complementarily heating the resulting steel pipe in a temperature range from the $Ac_3$ transformation point to 1000° C. in-line, and then quenching it from a temperature not lower than the $Ar_3$ transformation point followed by tempering at a temperature range from 600° C. to the $Ac_1$ transformation point:

$$C+(Mn/6)+(Cr/5)+(Mo/3)\geqq 0.43 \quad (1),$$

$$Ti\times N<0.0002-0.0006\times Si \quad (2),$$

wherein C, Mn, Cr, Mo, Ti, N and Si in the above formulas (1) and (2) represent the mass percent of the respective elements.

Hereinafter, the above-mentioned inventions (1) and (2) related to the methods for producing a seamless steel pipe are referred to as "the present invention (1)" and "the present invention (2)", respectively. They are sometimes collectively referred to as "the present invention".

The term "REM" as used in the present invention is the general name of 17 elements including Sc, Y and lanthanoid, and the content of REM means the sum of the contents of the said elements.

Effects of the Invention

According to the present invention, a seamless steel pipe, having a uniform and fine tempered martensitic microstructure with austenite grains being fine and having a grain size number of not less than 7, and having high strength and excellent toughness as well as a high yield ratio and excellent SSC resistance, can be produced by efficient means and is capable of realizing energy savings.

BEST MODES FOR CARRYING OUT THE INVENTION

In order to increase the SSC resistance, it is necessary to increase the yield ratio. Therefore, the present inventors first made investigations concerning the influences of the constituent elements on the yield ratio of quenched and tempered steel products. As a result, the following findings (a) to (e) were obtained.

(a) The yield ratio of a steel product having a quenched and tempered microstructure is most significantly influenced by the content of C and, when the C content is reduced, the yield ratio generally increases.

(b) Even if the C content is merely reduced, a uniform quenched microstructure cannot be obtained since the hardenability is deteriorated, and the yield ratio cannot be sufficiently raised.

(c) The reduced hardenability due to the reduction in the C content can be improved by adding B in order to make its segregation at the grain boundaries and also to suppress the ferrite transformation from the grain boundary. However, this alone is not sufficient so the simultaneous addition of Mn, Cr and Mo, each at an appropriate content level, is indispensable.

(d) When the value of the formula "C+(Mn/6)+(Cr/5)+(Mo/3)" is set to not less than 0.43, a uniform quenched microstructure can be obtained in the general steel pipe quenching facilities. In the above formula, C, Mn, Cr and Mo represent the mass percent of the respective elements.

(e) When the value of the above formula is not less than 0.43, the hardness in a position 10 mm from the quenched end in a Jominy test exceeds the hardness corresponding to a martensite ratio of 90% and satisfactory hardenability can be ensured. The said value is preferably set to not less than 0.45, and more preferably to not less than 0.47.

The above investigations thus revealed that even when the yield strength is in excess of 759 MPa (110 ksi), the hardness can be maintained at a low level and excellent SSC resistance can be ensured if the yield ratio is increased.

Therefore, in order to increase the production efficiency, the steel products were heated, pierced, elongated, rolled and finally rolled at a finish rolling temperature not lower than the $Ar_3$ transformation point. Then the resulting steel pipes were in-line quenched from a temperature not lower than the $Ar_3$ transformation point and further tempered, and the properties of the pipes obtained were examined.

As a result, it was revealed that in the case of producing steel pipes by in-line quenching treatments, where those steel pipes were finishing rolled at a temperature not lower than the $Ar_3$ transformation point and subjected to a direct quenching treatment while the temperature thereof was not lower than the said $Ar_3$ transformation point, or instead of the above direct quenching treatment the said finishing rolled pipes were complementarily heated in a supplemental heating furnace set at the $Ar_3$ transformation point or above and then subjected to quenching, such a process for making the grains finer by repetitions of transformation and reverse transformation which are found in an off-line quenching treatment is absent and, therefore, in the case of the steel pipes produced by the said in-line quenching treatment and have a yield strength exceeding 759 MPa (110 ksi), the size of austenite grains increases and the toughness deteriorates sometimes.

Consequently, the present inventors arrived at the conclusion that in order to obtain a steel pipe, having such high strength that the yield strength is in excess of 759 MPa (110 ksi), and also having excellent toughness by an in-line pipe-making rolling and quenching process, it is necessary to make the austenite grains finer after finishing the pipe-making rolling.

Then, the present inventors made intensive investigations in search of a method for making the austenite grains finer in the in-line quenching treatment where the pipe-making rolling and quenching treatment are completed at high temperature ranges. As a result, the following findings (f) and (g) were first obtained.

(f) In order to render austenite grains finer in the in-line quenching treatment, it is necessary to finely disperse particles capable of showing a pinning effect at grain boundaries even at high temperatures.

(g) TiN, which is hardly dissolved even at high temperatures and hardly becomes coarse, can be used in the above-mentioned pinning particles. That is to say, when TiN is finely dispersed during heating prior to the pipe-making rolling from a steel billet, it becomes possible to render austenite grains finer in the steel pipe prior to the in-line quenching treatment.

Then, for further investigation in search of a method for dispersing TiN, steel billets containing various components were used and examined for the amounts of precipitated TiN. That is to say, test specimens for extraction residue analysis and extraction replicas were taken from the central part of each of the steel billets, cast by means of a continuous casting machine using a mold round in section, so-called "round CC billets", and the amounts of the precipitated TiN and the state of dispersion thereof were examined by an extraction residue analysis and observations by an electron microscope. As a result, the following findings (h) and (i) were obtained.

(h) For the fine dispersion of the TiN at the time of heating prior to the pipe-making rolling from the steel billets, it is important that the steel composition contains large amounts of Ti and N. However, the mere addition of the Ti and N in large amounts results in nucleation of TiN in a high-temperature state during solidification, which results in the TiN nuclei becoming coarse.

(i) Not only the contents of Ti and N, but also the content of Si exerts a great influence on the amount of precipitated TiN and therefore, by controlling the content of Si, it is possible to prevent the formation and coarsening of TiN during solidification, while allowing the Ti and N to be contained in large amounts. That is to say, even when steels have the same Ti and N content, the amount of precipitated TiN in the steel billets is smaller if there is a steel less Si content; the Ti exists in the form of a supersaturated state in the steel billets. This is presumably due to the inhibition of the formation and growth of TiN at the time of solidification by the reducing Si content.

Next, the present inventors used steel billets (round CC billets) containing various amounts of precipitated TiN, heated and pierced them and then subjected them to pipe-making rolling and in-line quenching treatment, and examined the austenite grain sizes after the said in-line quenching treatment. As a result, the following important finding (j) was obtained.

(j) The smaller the amount of precipitated TiN in the steel billets is, the smaller the austenite grain size after the in-line quenching treatment is. This is due to the fact that TiN begins to precipitate at the lower temperature on the occasion of the temperature of steel billets which contain dissolved Ti and N before the pipe-making rolling is raised from room temperature to high temperatures, and is finely dispersed and effectively functions as pinning particles. TiN is stable in austenite phase and will not dissolve in the matrix even at high temperatures, so that it stably and reliably produces the effect of pinning particles.

As a result, the present inventors arrived at the conclusion that in order to make austenite grains finer in the in-line quenching process, it is important to use steel billets in small amounts of precipitated TiN, that is to say, steel billets in which Ti and N are dissolved each in a supersaturated state.

Therefore, the present inventors further made detailed examinations concerning the relationship between the Ti, N and Si contents and the amounts of dissolved Ti and N in steel billets. As a result, the following finding (k) was obtained.

(k) In order to render the austenite grains sufficiently fine by in-line quenching treatment, it is necessary that the steel billet satisfies the following formula (2), wherein Ti, N and Si represent the mass percent of the respective elements:

$$Ti \times N < 0.0002 - 0.0006 \times Si \quad (2).$$

The present inventors further examined the influences of the alloying elements and the steel ingot heating temperature before rolling on the toughness and SSC resistance of a steel product which was produced by in-line quenching treatment and tempering process. An example of the results obtained is as follows.

First, each of steels A to C having chemical compositions shown in Table 1 was melted by use of a 150 kg vacuum melting furnace, and then each melt was cast into a tetragonal prism-shaped mold of which each side was 200 mm in length-producing a steel ingot.

TABLE 1

| | Chemical composition (mass %) The balance: Fe and impurities | | | | | | | | | | | | |
|---|---|---|---|---|---|---|---|---|---|---|---|---|---|
| Steel | C | Si | Mn | P | S | Cr | Mo | V | Nb | Ti | B | Ca | Al |
| A | 0.16 | 0.11 | 0.81 | 0.010 | 0.002 | 0.35 | 0.51 | 0.08 | — | 0.015 | 0.0010 | 0.0025 | 0.042 |
| B | 0.16 | 0.12 | 0.80 | 0.010 | 0.002 | 0.36 | 0.44 | 0.07 | — | 0.025 | 0.0015 | 0.0025 | 0.033 |
| C | 0.16 | 0.13 | 0.67 | 0.010 | 0.003 | 0.33 | 0.16 | 0.09 | — | 0.017 | 0.0010 | 0.0022 | 0.035 |

TABLE 1-continued

| Steel | Chemical composition (mass %) The balance: Fe and impurities N | A value | Formula (2) | Dissolved Ti | Transformation point (C) $Ac_1$ | $Ac_3$ | $Ar_3$ | $JHRC_{10}$ | (C % × 58) + 27 |
|---|---|---|---|---|---|---|---|---|---|
| A | 0.0040 | 0.535 | ○ | 0.011 | 746 | 869 | 762 | 41.4 | 36.3 |
| B | 0.0077 | 0.512 | X | 0.002 | 744 | 855 | 754 | 41.8 | 36.8 |
| C | 0.0044 | 0.391 | ○ | 0.009 | 740 | 859 | 750 | 31.6 | 36.3 |

In the column "A value", the value indicates the left-hand side of the formula (1), i.e. "C + (Mn/6) + (Cr/5) + (Mo/3)".
In the column "Formula (2)", the case where the formula "Ti × N < 0.0002-0.0006 × Si" is satisfied is indicated by symbol "○" and the case where the said formula is not satisfied is indicated by symbol "X".
"Dissolved Ti" means the value obtained by subtracting the Ti content in the residue from the content of Ti.
$JHRC_{10}$ means the Rockwell C hardness in the position 10 mm from the quenched End in the Jominy test.
"(C % × 58) + 27" indicates the predicted value of the Rockwell C hardness at 90%-martensite ratio based on the C content.

A small cylindrical test specimen with a diameter of 10 mm and a length of 100 mm was taken from the top central portion of each steel ingot, obtained in a top-to-bottom direction, for extraction residue testing, and subjected to extraction residue analysis, and the content of Ti in the residue was examined. Further, a Jominy test specimen was taken from a part of the steel ingot and, after austenitizing at 950° C., subjected to the Jominy test, and the hardenability of each steel was examined.

The value obtained by subtracting the Ti content in the residue from the content of Ti in each steel ingot is shown as "Dissolved Ti" in Table 1. In the column "Formula (2)", which concerns the contents of Ti, N and Si, in Table 1, the case where formula (2) is satisfied is indicated by the symbol "○" and the case where the said formula (2) is not satisfied is indicated by the symbol "x". In Table 1, the value of the formula "C+(Mn/6)+(Cr/5)+(Mo/3)" ("A value" in Table 1) and the $Ac_1$, $Ac_3$ and $Ar_3$ transformation points are also shown for each steel.

J. M. Hodge and M. A. Orehoski: "Relationship between hardenability and percentage martensite in some low-alloy steels", Trans. AIME, 167 (1946), pp. 627-642.

Next, the remainder of each steel ingot was divided into 5 portions, which were subjected to a heat treatment of soaking at various temperatures within the range of 1000 to 1300° C. for 2 hours, as shown in Table 2, and then immediately transferred to a hot rolling mill and hot-rolled to 16 mm thick steel plates at a finish rolling temperature of not lower than 950° C. Each hot-rolled steel plate was then transferred to a heating furnace before the surface temperature thereof becomes lower than the $Ar_3$ transformation point and allowed to stand therein at 950° C. for 10 minutes for complementary heating, and then inserted and water-quenched in an agitating water tank from 930° C.

Test specimens for microstructure observation were cut out from each of the thus-obtained steel plates as water-quenched condition and measured for austenite grain size according to the ASTM E 112 method. The remainder of each steel plate was subjected to a tempering treatment of soaking at a temperature of 690° C. or 700° C. for 30 minutes, as shown in Table 2.

TABLE 2

| Steel | Mark | Steel ingot heating temp. before rolling (C.) | Complementary heating temp. after rolling (C.) | Quenching temp. (C.) | Tempering temp. (C.) | Austenite grain size number | Tensile properties YS (MPa) | TS (MPa) | YR (%) | Toughness vTE (C) | SSC resistance Critical stress |
|---|---|---|---|---|---|---|---|---|---|---|---|
| A | 1 | 1000 | 950 | 930 | 700 | 10.0 | 841 | 862 | 97.6 | −70 | 95% YS |
| | 2 | 1100 | | | | 9.5 | 841 | 869 | 96.8 | −65 | 95% YS |
| | 3 | 1200 | | | | 8.5 | 869 | 897 | 96.9 | −58 | 90% YS |
| | 4 | 1250 | | | | 7.5 | 862 | 903 | 95.4 | −50 | 90% YS |
| | 5 | 1300 | | | | 4.0 | 876 | 924 | 94.8 | −8 | 90% YS |
| B | 1 | 1000 | 950 | 930 | 690 | 6.8 | 854 | 917 | 93.1 | 8 | 90% YS |
| | 2 | 1100 | | | | 6.3 | 821 | 883 | 93.0 | 6 | 90% YS |
| | 3 | 1200 | | | | 5.7 | 848 | 924 | 91.8 | 7 | 90% YS |
| | 4 | 1250 | | | | 5.4 | 862 | 952 | 90.6 | 12 | 90% YS |
| | 5 | 1300 | | | | 3.5 | 869 | 966 | 90.0 | 10 | 90% YS |
| C | 1 | 1000 | 950 | 930 | 690 | 9.6 | 800 | 903 | 88.5 | −60 | 85% YS |
| | 2 | 1100 | | | | 8.9 | 828 | 940 | 88.0 | −57 | 80% YS |
| | 3 | 1200 | | | | 8.0 | 841 | 952 | 88.4 | −48 | 80% YS |
| | 4 | 1250 | | | | 7.0 | 848 | 966 | 87.9 | −43 | 80% YS |
| | 5 | 1300 | | | | 3.2 | 869 | 1007 | 86.3 | 5 | 75% YS |

Further, the Rockwell C hardness in the position 10 mm from the quenched end in the Jominy test ($JHRC_{10}$) of each steel A to C and the Rockwell C hardness predicted value at 90%-martensite ratio corresponding to the C content of each steel are shown in Table 1. The position 10 mm from the quenched in the Jominy test corresponds to a cooling rate of about 20° C./second. The predicted value of the Rockwell C hardness at 90%-martensite ratio based on the C content is given by "(C %×58)+27" as shown in the document cited below:

Then, No. 4 test pieces for tensile testing regulated in JIS Z 2201 (1998) and 10 mm width V-notched test pieces regulated in JIS Z 2202 (1998) were cut off from the central portion (in the direction of plate thickness) of each tempered steel plate in the direction of rolling, and tensile properties and toughness were examined. That is to say, the yield strength (YS), tensile strength (TS) and yield ratio (YR) were measured by tensile testing at room temperature. Further, the Charpy impact test was carried out to determine the energy transition temperature (vTE).

Further, round bar test specimens with a parallel portion diameter of 6.35 mm and a parallel portion length of 25.4 mm were cut off from the central portion (in the direction of plate thickness) of each steel plate after tempering in the direction parallel to the direction of rolling, and tests for SSC resistance were carried out in accordance with the NACE-TM-0177-A-96 method. That is to say, the critical stress (maximum applied stress causing no rupture in a test time of 720 hours, shown by the ratio to the actual yield strength of each steel plate) was measured in the circumstance of 0.5% acetic acid+5% sodium chloride aqueous solution saturated with hydrogen sulfide of the partial pressure of 101325 Pa (1 atm) at 25° C.

The austenite grain size number of each steel plate as water-quenched condition, and the tensile properties, toughness and SSC resistance of each tempered plate are shown in Table 2.

The steel A satisfies the formula (2) given above, as shown in Table 1, and the content of dissolved Ti in the steel ingot thereof is high. Therefore, it is possible to get TiN to precipitate sufficiently finely by heating prior to rolling and, as shown in Table 2 under marks 1 to 4, austenite grains were rendered finer and excellent toughness was obtained by employing a heating temperature of 1000 to 1250° C. before rolling. Further, as shown in Table 1, the steel A satisfies the formula (1) given hereinabove, so that even when it is austenitized at 950° C. and quenched, a martensitic microstructure with a martensite ratio of not lower than 90% can be ensured and the yield ratio is also high, therefore the SSC resistance is excellent.

The steel B does not satisfy the formula (2) given above, as shown in Table 1, and the dissolved Ti content in the steel ingot thereof is low. Therefore, the heating prior to rolling fails to get TiN to precipitate to a sufficient extent and, as shown in Table 2, the austenite grains become coarse, so that the energy transition temperature (vTE) is high and the toughness is low.

The steel C satisfies the formula (2) given above, as shown in Table 1, and the content of dissolved Ti in the steel ingot thereof is high. Therefore, it is possible to get TiN to precipitate out sufficiently finely by heating prior to rolling and, as shown in Table 2 under marks 1 to 4, austenite grains were rendered finer by employing a heating temperature of 1000 to 1250° C. before rolling. However, as shown in Table 1, the value A, namely the value of the formula represented by "C+(Mn/6)+(Cr/5)+(Mo/3)", is 0.391, failing to satisfy the formula (1) given hereinabove, so that the hardenability is insufficient. Therefore, the steel C is inferior in SSC resistance, as shown in Table 2.

The finely dispersed TiN readily aggregates and tends to coarsen at 1300° C. Therefore, when the heating temperature before rolling was 1300° C., all the grains of steels A to C were coarse.

The reason for specifying the chemical composition of the steel billet which is the raw materials of a seamless steel pipe in the present invention will be now described in detail.

C: 0.15 to 0.20%

C is an element effective for inexpensively enhancing the strength of steel. However, with the C content of less than 0.15%, a low-temperature tempering treatment must be performed to obtain a desired strength, which causes a deterioration in SSC resistance, or the necessity of addition of a large amount of expensive elements to ensure hardenability. On the other hand, with the C content exceeding 0.20%, the yield ratio is reduced, and when a desired yield strength is obtained, an increase of hardness is caused which deteriorates the SSC resistance. And further, the toughness also deteriorates due to the occurrence of carbides in large amounts. Accordingly, the content of C is set to 0.15 to 0.20%. The preferable range of the C content is 0.15 to 0.18%, and the more preferable range thereof is 0.16 to 0.18%.

Si: not less than 0.01% to less than 0.15%

Si is an element, which improves the hardenability of steel to enhance the strength in addition to a deoxidation effect, and a content of 0.01% or more is required. However, when the content of Si is 0.15% or more, coarse TiN begins to precipitate, adversely affecting the toughness. Therefore, the content of Si is set to not less than 0.01% to less than 0.15%. The preferable range of the Si content is 0.03 to 0.13%, and the more preferable range thereof is 0.07 to 0.12%.

Mn: 0.05 to 1.0%

Mn is an element, which improves the hardenability of steel to enhance the strength in addition to a deoxidation effect, and a content of 0.05% or more is required. However, when the content of Mn exceeds 1.0%, the SSC resistance is deteriorated. Accordingly, the content of Mn is set to 0.05 to 1.0%.

Cr: 0.05 to 1.5%

Cr is an element effective for enhancing the hardenability of steel, and a content of 0.05% or more is required in order to exhibit this effect. However, when the content of Cr exceeds 1.5%, the SSC resistance is deteriorated. Therefore, the content of Cr is set to 0.05 to 1.5%. The preferable range of the Cr content is 0.2 to 1.0%, and the more preferable range thereof is 0.4 to 0.8%.

Mo: 0.05 to 1.0%

Mo is an element effective for enhancing the hardenability of steel to ensure a high strength and for enhancing the SSC resistance. In order to obtain these effects, it is necessary to control the content of Mo to 0.05% or more. However, when the content of Mo exceeds 1.0%, coarse carbides are formed in the austenite grain boundaries which deteriorate the SSC resistance. Therefore, the content of Mo of 0.05 to 1.0% is required. The preferable range of the Mo content is 0.1 to 0.8%.

Al: not more than 0.10%

Al is an element having a deoxidation effect and is effective for enhancing the toughness and workability. However, when the content of Al exceeds 0.10%, streak flaws remarkably take place. Accordingly, the content of Al is set to not more than 0.10%. Although the lower limit of the Al content is not particularly set because the content may be at an impurity level, the Al content is preferably set to not less than 0.005%. The preferable range of the Al content is 0.005 to 0.05%. The Al content referred herein means the content of acid-soluble Al (what we called the "sol. Al").

V: 0.01 to 0.2%

V precipitates out as fine carbides at the time of tempering, and so it enhances the strength. In order to obtain this effect, it is necessary to control the content of Mo to 0.01% or more. However, when the content of V exceeds 0.2%, V carbides are formed in excessive amounts and cause a deterioration in toughness. Therefore, the content of V is set to 0.01 to 0.2%. The preferable range of the V content is 0.05 to 0.15%.

Ti: 0.002 to 0.03%

Ti fixes N in steel as a nitride and makes B present in a dissolved state in the matrix at the time of quenching to make it create a hardenability improving effect. Furthermore, in an in-line pipe-making rolling and quenching process, Ti precipitates as fine TiN abundantly in the step of heating prior to pipe-making rolling and has an effect of making austenite grains finer. In order to obtain these effects of Ti, it is necessary to control the content of Ti to 0.002% or more. However, when the content of Ti is 0.03% or more, it is present as a coarse nitride, resulting in the deterioration of the SSC resistance. Accordingly, the content of Ti is set to 0.002 to 0.03%. The preferable range of the Ti content is 0.005 to 0.025%.

B; 0.0003 to 0.005%

B has a hardenability improving effect. Although the said effect of B can be obtained with a content at an impurity level, the B content is preferably set to 0.0003% or more in order to obtain a more remarkable effect. However, when the content of B exceeds 0.005%, the toughness is deteriorated. Therefore, the content of B is set to 0.0003 to 0.005%. The preferable range of the B content is 0.0003 to 0.003%.

N: 0.002 to 0.01%

In an in-line pipe-making rolling and quenching process, N precipitates as fine TiN abundantly in the step of heating prior to pipe-making rolling and has an effect of making austenite grains finer. In order to obtain such effect of N, it is necessary to control the content of N to 0.002% or more. However, when the N content increases, in particular when the content of N exceeds 0.01%, it causes coarse AlN and TiN and, in addition, forms BN together with B and causes a decrease in the amount of dissolved B in the matrix, thus markedly deteriorating the hardenability. Therefore, the content of N is set to 0.002 to 0.01%.

The value of the formula represented by "C+(Mn/6)+(Cr/5)+(Mo/3)": not less than 0.43

The present invention is intended to raise the yield ratio by limiting C in order to improve the SSC resistance. Accordingly, if the contents of Mn, Cr and Mo are not adjusted according to the adjustment of the C content, the hardenability is impaired to rather deteriorate the SSC resistance. Therefore, in order to ensure the hardenability, the contents of C, Mn, Cr and Mo must be set so that the value of the formula represented by "C+(Mn/6)+(Cr/5)+(Mo/3)" is not less than 0.43, namely so that the formula (1) is satisfied. The preferable value of the formula represented by "C+(Mn/6)+(Cr/5)+(Mo/3)" is not less than 0.45, and the more preferable value is not less than 0.47.

The value of the formula represented by "Ti×N": less than the value of the formula represented by "0.002-0.0006×Si"

In an in-line pipe-making rolling and quenching process, it is necessary that TiN be finely dispersed for making austenite grains finer. Then, in order to render TiN to be finely dispersed, it is necessary to inhibit the generation of TiN in molten steel and thereby inhibit the formation and coarsening of TiN on the occasion of solidification while allowing Ti and N to be contained abundantly in the molten steel. While TiN in molten steel grows very rapidly to produce coarse particles, Si repulsively acts on Ti and, when the Si content is high, the activity of Ti increases, whereby the generation of TiN becomes simple. In other words, it is possible to inhibit the generation of TiN in molten steel by keeping the Si content at lower levels even when the contents of Ti and N are high. And, when the value of the formula represented by "Ti×N" is lower than the value of the formula represented by "0.002−0.0006×Si", namely when the formula (2) is satisfied, it is possible for TiN to be finely dispersed abundantly.

In the present invention, it is necessary to restrict the contents of P, S and Nb among impurities in the following manner.

P: not more than 0.025%

P is an impurity of steel, which causes a deterioration in toughness resulted from grain boundary segregation. Particularly when the content of P exceeds 0.025%, the toughness is remarkably deteriorated and the SSC resistance is also remarkably deteriorated. Therefore, it is necessary to control the content of P to not more than 0.025%. The content of P is preferably set to not more than 0.020% and, more preferably, to not more than 0.015%.

S: not more than 0.010%

S is also an impurity of steel, and when the content of S exceeds 0.010%, the SSC resistance is seriously deteriorated. Accordingly, the content of S is set to not more than 0.010%. The content of S is preferably set to not more than 0.005%.

Nb: less than 0.005%

The solubility of Nb in a steel is highly dependent on the temperature in the range of 800 to 1100° C. Therefore, Nb induces the formation of a mixed grain austenite or, in an in-line pipe-making rolling and quenching process, thereby causing variations in strength due to the heterogeneity of precipitates as resulting from slight temperature difference. In particular when the content of Nb is 0.005% or more, the variations in strength become remarkable. Therefore, the content of Nb is set to less than 0.005%. It is preferable that the Nb content be as low as possible.

From the above reasons, the chemical composition of the steel billet which is a raw materials of a seamless steel pipe in the method for producing a seamless pipe related to the present invention (1) was regulated as one that contains the above-mentioned elements from C to N in the respective content ranges and satisfies the formulas (1) and (2) given above, with the balance being Fe and impurities, wherein the content of P is not more than 0.025%, the content of S is not more than 0.010% and the content of Nb is less than 0.005% among the impurities.

The chemical composition of the steel billet, being a raw material of a seamless steel pipe in the method for producing a seamless pipe related to the present invention, can selectively contain one or more elements selected from among Ca: 0.0003 to 0.01%, Mg: 0.0003 to 0.01% and REM: 0.0003 to 0.01%. That is to say, one or more elements of the above-mentioned Ca, Mg and REM can be added thereto as optional additive elements.

The optional additive elements are described as follows:

Ca: 0.0003 to 0.01%, Mg: 0.0003 to 0.01%, REM: 0.0003 to 0.01%

Each of Ca, Mg and REM, if added, has the effect of enhancing the SSC resistance by reacting with S in the steel to form a sulfide thus improving the impurity form. However, when the content of each is less than 0.0003%, such effect cannot be obtained. On the other hand, when the content of each exceeds 0.01%, as the amount of impurities in the steel increases, thereby the index of cleanliness of the steel deteriorates and the SSC resistance rather deteriorates. Therefore, if Ca, Mg and REM are added, the contents thereof each be preferably set to 0.0003 to 0.01%. The above Ca, Mg and REM can be added alone or in combination of two or more thereof.

As already mentioned hereinabove, the term "REM" is the general name of 17 elements including Sc, Y and lanthanoid, and the content of REM means the sum of the content of the said elements.

From the above reason, the chemical composition of the steel billet which is a raw material of a seamless steel pipe in the method for producing a seamless pipe related to the present invention (2) was regulated as one that contains the above-mentioned elements from C to N in the respective content ranges and, further, one or more elements selected from among Ca: 0.0003 to 0.01%, Mg: 0.0003 to 0.01% and REM: 0.0003 to 0.01%, and satisfies the formulas (1) and (2) given above, with the balance being Fe and impurities, wherein the content of P is not more than 0.025%, the content of S is not more than 0.010% and the content of Nb is less than 0.005% among the impurities.

The method for producing a seamless steel pipe related to the present invention is characterized in the steel billet heating temperature, the final rolling temperature and the heat treatment after the end of rolling. Each will be described below.

(A) Steel Billet Heating Temperature

The temperature for heating the steel billet prior to pipe-making rolling is preferably as low as possible. However, when the temperature is lower than 1000° C., the piercing plug is severely damaged and mass production on an industrial scale becomes impossible. On the other hand, when the temperature is over 1250° C. the TiN particles once finely dispersed in the lower temperature range grow in the manner of Ostwald ripening and readily aggregate and tend to coarsen and, as a result, their pinning effect deteriorates. Therefore, the temperature for heating the steel billet before pipe-making rolling is set to 1000 to 1250° C. The steel billet heating temperature is preferably set to 1050 to 1200° C., and more preferably set to 1050 to 1150° C.

It is not necessary to impose any particular conditions concerning the heating of the steel billet to the above-mentioned temperature range prior to pipe-making rolling. However, when the rate of heating is low, TiN finely precipitates on the low temperature side and this creates sufficiently fine grains and, therefore, the heating is preferably carried out at a rate of heating of not more than 15° C./minute. It is also appropriate to employ a two-step heating pattern of the steel billet during the heating from room temperature, to a temperature between the $Ac_1$ transformation point to the $Ac_3$ transformation point, or a temperature in the vicinity thereof, for a while in order to finely disperse the TiN and then heating it to the desired heating temperature. Further, the process subjecting the steel billet to preheating treatment in the temperature range between 600° C. and the $Ac_3$ transformation point in order to finely disperse the TiN in the ferrite region, then cooling the steel billet to room temperature, and again heating the steel billet to the predetermined heating temperature prior to pipe-making rolling, is also suitable.

The steel billet, which is served as the raw materials for a seamless steel pipe, is only required to contain the dissolved Ti abundantly. The method for producing the same is not particularly restricted. However, in order to obtain the dissolved Ti abundantly, it is preferable to employ a steel billet making process in which the rate of cooling is high. Therefore, for example, the steel billet is preferably produced in continuous casting equipment using a mold round in section, namely the so-called "round CC equipment".

(B) Final Rolling Temperature

When the final rolling temperature is lower than 900° C., the deformation resistance of the steel pipe is excessively increased and mass production on an industrial scale becomes impossible. On the other hand, at a temperature higher than 1050° C., the coarsening of the grains takes place and results in a recrystallization during rolling. Therefore, it is necessary that the final rolling temperature should be set to 900 to 1050° C.

If the final rolling temperature is set to 900 to 1050° C., the method for rolling a seamless steel pipe is not particularly restricted. From the viewpoint of ensuring high production efficiency, for instance, the piercing, elongating and rolling is preferably carried out by the Mannesmann-mandrel mill pipe-making method in order to create the final shape.

(C) Complementary Heating Treatment

The steel pipe, after the end of pipe-making rolling at the final rolling temperature mentioned above under (B), may be quenched from a temperature of not lower than the $Ar_3$ transformation point. However, it is preferably to carry out in-line complementary heating so that the homogeneity of the heating may be ensured in the directions of the length and thickness of the steel pipe after the end of pipe-making rolling.

When the complementary heating temperature is lower than the $Ac_3$ transformation point, ferrite precipitates and renders the microstructure heterogeneous. On the other hand, when the said complementary heating temperature is higher than 1000° C., the coarsening of grains advances. Therefore, the temperature in in-line complementary heating is set to the range of from the $Ac_3$ transformation point to 1000° C. The preferable complementary heating temperature is from the $Ac_3$ transformation point to 950° C. Even when the complementary heating time is about 1 to 10 minutes, sufficiently homogeneous heating can be ensured along the whole length of the steel pipe.

(D) Quenching and Tempering

The steel pipe after passage through the above steps (A) and (B) or (A) to (C), is quenched from a temperature not lower than the $Ar_3$ transformation point. The quenching is carried out at a cooling rate sufficient for making the whole wall thickness of the pipe into a martensitic microstructure. Water cooling is generally adapted.

After quenching treatment, tempering treatment is carried out in the temperature range of from 600° C. to the $Ac_1$ transformation point. When the tempering temperature is lower than 600° C., the SSC resistance deteriorates since the cementite, which precipitates during tempering, is acicular. On the other hand when the tempering temperature is higher than the $Ac_1$ transformation point, the parent phase partly undergoes reverse transformation to create a heterogeneous microstructure, so that the SSC resistance deteriorates. The tempering time is generally 10 to 120 minutes, however it depends on the pipe wall thickness.

The present invention will be described more detail in reference to examples.

EXAMPLES

Steel billets (round CC billets), with an outside diameter of 225 mm of 21 kinds of steels D to X, having respective chemical compositions shown in Table 3 were produced by the continuous casting method. In Table 3, the value of the formula "C+(Mn/6)+(Cr/5)+(Mo/3)" ("A value" in Table 3) and the $Ac_1$, $Ac_3$ and $Ar_3$ transformation points are also shown for each steel billet. In the column "Formula (2)", which concerns the contents of Ti, N and Si, in Table 3, the case in which formula (2) is satisfied is indicated by the symbol "○" and the case in which the said formula (2) is not satisfied is indicated by the symbol "x".

Seamless steel pipes, with an outer diameter of 244.5 mm and a wall thickness of 13.8 mm, were produced by piercing, elongating and rolling by the Mannesmann-mandrel mill pipe-making method. The final finish rolling in order to create the final shape is followed by an in-line quenching treatment and subsequent tempering. The steel billet heating temperature, final rolling temperature, complementary heating temperature and in-line quenching temperature used are shown in Table 4.

The complementary heating time was 10 minutes, and the quenching was carried out in the manner of water quenching. The tempering conditions were adjusted for each steel so that the yield strength might be in the vicinity of the upper limit of the so-called "110 ksi class steel pipe", namely 862 MPa. That is to say, short steel pipes obtained by cutting each steel pipe as quenched condition were subjected to tempering treatment at various temperatures not higher than the $Ac_1$ transformation point using a test heating furnace. The relationship between the tempering temperature and the yield strength was determined for each steel and, based on the relationship obtained, the temperature suited having a yield strength of about 862 MPa was selected, and the tempering was carried out by maintaining the steel pipe at that suitable temperature for 30 minutes.

Using each steel pipe as quenched condition, the austenite grain size was measured and, further, various test specimens were cut out from each steel pipe after tempering and subjected to the tests described below. The properties of the seamless steel pipe were also examined and the hardenability of each steel was examined.

TABLE 3

| | Chemical composition (mass %) The balance: Fe and impurities | | | | | | | | | | | |
|---|---|---|---|---|---|---|---|---|---|---|---|---|
| Steel | C | Si | Mn | P | S | Cr | Mo | Al | V | Nb | Ti | B |
| D | 0.15 | 0.13 | 0.91 | 0.010 | 0.002 | 0.43 | 0.70 | 0.024 | 0.11 | 0.0002 | 0.016 | 0.0018 |
| E | 0.17 | 0.11 | 0.61 | 0.010 | 0.004 | 0.61 | 0.51 | 0.026 | 0.09 | 0.0001 | 0.017 | 0.0021 |
| F | 0.15 | 0.08 | 0.56 | 0.010 | 0.004 | 0.30 | 0.40 | 0.025 | 0.16 | 0.0002 | 0.013 | 0.0031 |
| G | 0.19 | 0.14 | 0.60 | 0.010 | 0.004 | 0.31 | 0.50 | 0.029 | 0.03 | 0.0001 | 0.020 | 0.0017 |
| H | 0.17 | 0.05 | 0.60 | 0.010 | 0.004 | 0.61 | 0.45 | 0.032 | 0.07 | 0.0002 | 0.023 | 0.0012 |
| I | 0.16 | 0.11 | 0.63 | 0.010 | 0.004 | 0.60 | 0.61 | 0.031 | 0.03 | 0.0001 | 0.018 | 0.0038 |
| J | 0.16 | 0.14 | 0.72 | 0.010 | 0.003 | 0.36 | 0.40 | 0.030 | 0.06 | 0.0002 | 0.015 | 0.0020 |
| K | 0.15 | 0.09 | 0.68 | 0.012 | 0.004 | 0.34 | 0.37 | 0.025 | 0.03 | 0.0001 | 0.018 | 0.0020 |
| L | 0.19 | 0.13 | 0.77 | 0.010 | 0.005 | 0.41 | 0.40 | 0.027 | 0.05 | 0.0002 | 0.013 | 0.0031 |
| M | 0.18 | 0.12 | 0.81 | 0.008 | 0.004 | 0.36 | 0.35 | 0.022 | 0.08 | 0.0001 | 0.019 | 0.0025 |
| N | 0.17 | 0.08 | 0.78 | 0.008 | 0.003 | 0.45 | 0.45 | 0.035 | 0.06 | 0.0002 | 0.021 | 0.0020 |
| O | 0.17 | 0.09 | 0.76 | 0.007 | 0.002 | 0.40 | 0.52 | 0.033 | 0.02 | 0.0001 | 0.015 | 0.0025 |
| P | 0.18 | 0.11 | 0.69 | 0.009 | 0.003 | 0.38 | 0.57 | 0.031 | 0.12 | 0.0002 | 0.019 | 0.0025 |
| Q | 0.15 | 0.13 | 0.77 | 0.012 | 0.002 | 0.39 | 0.71 | 0.026 | 0.15 | 0.0001 | 0.023 | 0.0018 |
| R | 0.16 | 0.12 | 0.75 | 0.011 | 0.002 | 0.56 | 0.65 | 0.022 | 0.08 | 0.0002 | 0.014 | 0.0024 |
| S | 0.16 | 0.14 | 0.76 | 0.015 | 0.003 | 0.57 | 0.55 | 0.028 | 0.06 | 0.0001 | 0.018 | 0.0023 |
| T | 0.18 | 0.14 | 0.77 | 0.008 | 0.003 | 0.70 | 0.60 | 0.033 | 0.08 | 0.0004 | 0.020 | 0.0025 |
| U | 0.18 | 0.10 | 0.65 | 0.008 | 0.004 | 0.65 | 0.45 | 0.041 | 0.02 | 0.0003 | 0.022 | 0.0025 |
| V | *0.27 | 0.11 | 0.48 | 0.012 | 0.003 | 0.64 | 0.26 | 0.019 | 0.06 | — | 0.012 | 0.0010 |
| W | 0.16 | 0.08 | 0.81 | 0.012 | 0.002 | 0.36 | 0.15 | 0.031 | 0.04 | — | 0.014 | 0.0011 |
| X | 0.17 | 0.10 | 0.61 | 0.008 | 0.003 | 0.75 | 0.43 | 0.025 | 0.05 | — | 0.028 | 0.0015 |

| | Chemical composition (mass %) The balance: Fe and impurities | | | | | | Transformation point (C) | | |
|---|---|---|---|---|---|---|---|---|---|
| Steel | N | Ca | Mg | REM | A value | Formula (2) | $Ac_1$ | $Ac_3$ | $Ar_3$ |
| D | 0.0048 | — | — | — | 0.621 | ○ | 755 | 879 | 773 |
| E | 0.0038 | — | — | — | 0.564 | ○ | 750 | 865 | 762 |
| F | 0.0068 | — | — | — | 0.437 | ○ | 746 | 873 | 782 |
| G | 0.0050 | — | — | — | 0.519 | ○ | 750 | 860 | 770 |
| H | 0.0036 | — | — | — | 0.542 | ○ | 755 | 862 | 766 |
| I | 0.0065 | — | — | — | 0.588 | ○ | 758 | 875 | 782 |
| J | 0.0070 | — | — | — | 0.485 | ○ | 750 | 868 | 785 |
| K | 0.0070 | — | — | — | 0.455 | ○ | 750 | 870 | 788 |
| L | 0.0080 | 0.0013 | — | — | 0.534 | ○ | 745 | 850 | 765 |
| M | 0.0056 | 0.0020 | — | — | 0.504 | ○ | 740 | 852 | 766 |
| N | 0.0062 | 0.0015 | — | — | 0.540 | ○ | 750 | 860 | 777 |
| O | 0.0090 | 0.0017 | — | — | 0.550 | ○ | 753 | 865 | 780 |
| P | 0.0058 | — | 0.0015 | — | 0.561 | ○ | 751 | 863 | 772 |
| Q | 0.0044 | — | 0.0017 | — | 0.593 | ○ | 754 | 883 | 780 |
| R | 0.0070 | 0.0016 | 0.0012 | — | 0.614 | ○ | 760 | 878 | 770 |
| S | 0.0052 | 0.0013 | 0.0007 | — | 0.584 | ○ | 755 | 870 | 768 |
| T | 0.0047 | — | — | 0.0005 | 0.648 | ○ | 760 | 860 | 765 |
| U | 0.0057 | 0.0017 | 0.0010 | 0.0010 | 0.568 | ○ | 758 | 858 | 762 |
| V | 0.0045 | — | — | — | 0.565 | ○ | 755 | 812 | 756 |
| W | 0.0052 | — | — | — | *0.417 | ○ | 743 | 850 | 777 |
| X | 0.0081 | 0.0018 | — | — | 0.565 | *X | 761 | 862 | 782 |

In the column "A value", the value indicates the left-hand side of the formula (1), i.e. "C + (Mn/6) + (Cr/5) + (Mo/3)".

In the column "Formula (2)", the case where the formula "Ti × N < 0.0002 − 0.0006 × Si" is satisfied is indicated by symbol "○" and the case where the said formula is not satisfied is indicated by symbol "X".

The symbol "*" means that the content fails to satisfy the conditions regulated in the present invention.

TABLE 4

| Division | Test No. | Steel | Steel ingot heating temp. before rolling (C.) | Final rolling temp. (C.) | Complementary heating temp. after rolling (C.) | Quenching temp. (C.) | Austenite grain size number | Tensile properties YS (MPa) | TS (MPa) | YR (%) | Toughness vTE (C) | SSC resistance Critical stress | Hardenability |
|---|---|---|---|---|---|---|---|---|---|---|---|---|---|
| Inventive | 1 | D | 1250 | 1030 | 950 | 930 | 7.2 | 862 | 910 | 94.7 | −52 | 90% YS | Excellent |
| | 2 | E | 1150 | 980 | 950 | 940 | 9.1 | 848 | 883 | 96.1 | −65 | 90% YS | Excellent |
| | 3 | F | 1200 | 1000 | no heating | 920 | 8.7 | 862 | 897 | 96.2 | −62 | 90% YS | Excellent |
| | 4 | G | 1100 | 900 | 920 | 900 | 9.7 | 855 | 883 | 96.9 | −75 | 90% YS | Excellent |

TABLE 4-continued

| Division | Test No. | Steel | Steel ingot heating temp. before rolling (C.) | Final rolling temp. (C.) | Complementary heating temp. after rolling (C.) | Quenching temp. (C.) | Austenite grain size number | Tensile properties YS (MPa) | TS (MPa) | YR (%) | Toughness vTE (C) | SSC resist-ance Critical stress | Harden-ability |
|---|---|---|---|---|---|---|---|---|---|---|---|---|---|
| | 5 | H | 1200 | 980 | 950 | 920 | 8.3 | 855 | 897 | 95.4 | −60 | 90% YS | Excellent |
| | 6 | I | 1050 | 900 | no heating | 870 | 10.0 | 862 | 890 | 96.9 | −75 | 90% YS | Excellent |
| | 7 | J | 1230 | 1000 | 950 | 930 | 8.0 | 862 | 910 | 94.7 | −60 | 90% YS | Excellent |
| | 8 | K | 1150 | 1020 | 950 | 930 | 9.2 | 855 | 897 | 95.4 | −65 | 90% YS | Excellent |
| | 9 | L | 1230 | 980 | no heating | 930 | 7.4 | 862 | 910 | 94.7 | −45 | 95% YS | Excellent |
| | 10 | M | 1240 | 1030 | 950 | 930 | 7.3 | 862 | 917 | 94.0 | −40 | 95% YS | Excellent |
| | 11 | N | 1220 | 1020 | 950 | 930 | 7.8 | 862 | 910 | 94.7 | −50 | 95% YS | Excellent |
| | 12 | O | 1150 | 1000 | 900 | 870 | 10.0 | 862 | 890 | 96.9 | −78 | 95% YS | Excellent |
| | 13 | P | 1250 | 1010 | 950 | 930 | 7.5 | 862 | 903 | 95.4 | −50 | 90% YS | Excellent |
| | 14 | Q | 1230 | 980 | 940 | 920 | 8.2 | 862 | 897 | 96.2 | −55 | 95% YS | Excellent |
| | 15 | R | 1180 | 1000 | 950 | 940 | 9.0 | 862 | 890 | 96.9 | −70 | 95% YS | Excellent |
| | 16 | S | 1200 | 980 | 920 | 900 | 8.3 | 862 | 897 | 96.2 | −65 | 95% YS | Excellent |
| | 17 | T | 1220 | 1030 | 950 | 920 | 7.8 | 862 | 910 | 94.7 | −58 | 95% YS | Excellent |
| | 18 | U | 1050 | 950 | 900 | 880 | 10.0 | 862 | 890 | 96.9 | −70 | 95% YS | Excellent |
| Comparative | 19 | *V | 1200 | 880 | 920 | 900 | 7.6 | 848 | 931 | 91.1 | −10 | 85% YS | Excellent |
| | 20 | *W | 1200 | 1050 | 950 | 930 | 8.5 | 848 | 966 | 87.9 | −40 | 80% YS | Inferior |
| | 21 | *X | 1200 | 1050 | 950 | 900 | 5.1 | 862 | 897 | 96.2 | 15 | 90% YS | Excellent |
| | 22 | D | *1300 | 1050 | 950 | 920 | 3.5 | 855 | 966 | 88.6 | 5 | 90% YS | Excellent |
| | 28 | F | 1250 | *1150 | 950 | 930 | 5.6 | 862 | 931 | 92.6 | 10 | 90% YS | Excellent |
| | 24 | G | 1250 | 1050 | *1050 | 950 | 5.8 | 862 | 945 | 91.2 | 20 | 90% YS | Excellent |

The hardenability was evaluated using a Jominy test piece taken from each steel ingot before pipe-making rolling.

The case where the Rockwell C hardness in a position 10 mm from a quenched end in the Jominy test was higher than the value of "(C % × 58) + 27" is indicates as "excellent" and the case where not higher than the said value as "inferior".

The symbol "*" means that the condition is outside one regulated in the present invention.

[1] Hardenability

A Jominy test piece was cut out from each steel billet before pipe-making rolling, austenitized at 950° C., and subjected to the Jominy test. The hardenability was evaluated by comparing the Rockwell C hardness in a position 10 mm from a quenched end ($JHRC_{10}$) with the value of "(C %×58)+27", which is the predicted value of the Rockwell C hardness corresponding to 90%-martensite ratio of each steel. It is determined that the one having a $JHRC_{10}$ higher than the value of "(C %×58)+27" has "excellent hardenability", and the one having a $JHRC_{10}$ not higher than the value of "(C %×58)+27" has "inferior hardenability".

[2] Austenite Grain Size

Test specimens (15 mm×15 mm in section) for microstructure observation were taken from the central portion (in the direction of thickness) of each steel pipe as quenched condition. Following mirror-like polishing of the surface, etched with a saturated aqueous solution of picric acid, observation under an optical microscope for austenite grain size was carried out and each austenite grain size number was determined according to the ASTM E 112 method.

[3] Tensile Test

A circular tensile test piece regulated in 5CT of the API standard was cut off in the longitudinal direction of each steel pipe, and a tensile test was carried out at room temperature in order to measure the yield strength (YS), tensile strength (TS) and yield ratio (YR).

[4] Charpy Impact Test

A 10 mm width V-notched test piece regulated in JIS Z 2202 (1998) was cut off in the longitudinal direction of each steel pipe, and a Charpy impact test was carried out in order to determine the energy transition temperature (vTE).

[5] SSC Resistance Test

A round bar test specimen with a diameter of 6.35 mm was cut out in the longitudinal direction of each steel pipe, and a SSC resistance test was carried out in accordance with the NACE-TM-0177-A-96 method. That is to say, the critical stress (maximum applied stress causing no rupture in a test time of 720 hours, shown by the ratio to the actual yield strength of each steel pipe) was measured in the circumstance of 0.5% acetic acid+5% sodium chloride aqueous solution saturated with hydrogen sulfide of the partial pressure of 101325 Pa (1 atm) at 25° C. The SSC resistance was evaluated to be excellent when the critical stress was 90% or more of the YS.

The examination results are also shown in Table 4. In the column "hardenability", each result of comparison between the $JHRC_{10}$ and the "(C %×58)+27" value is indicated by "excellent" or "inferior" based on the criteria already mentioned hereinabove.

From Table 4, it is apparent that the steels D to U having chemical compositions regulated in the present invention have excellent hardenability. The inventive steel pipes of Test Nos. 1 to 18 which were produced using the said steels under the conditions specified in the present invention have fine austenite grains and high yield ratio, and moreover, have excellent toughness and SSC resistance, in spite of their high yield strength of not lower than 848 MPa.

On the contrary, the comparative steel pipes of Test Nos. 19 to 21, which were produced under the conditions specified in the present invention, using the steels V to X whose chemical compositions are outside the range regulated by the present invention did not attain excellent SSC resistance and excellent toughness simultaneously.

That is to say, in the Test No. 19, the yield ratio is low and the SSC resistance deteriorated since the C content in the steel V used is outside the composition range according to the present invention.

In the Test No. 20, the value of the formula represented by "C+(Mn/6)+(Cr/5)+(Mo/3)" (A value) of the steel W used is outside the range specified by the present invention and, therefore, no uniform quenched microstructure can be obtained and the yield ratio is low, hence the SSC resistance deteriorated.

In the Test No. 21, the steel X used fails to satisfy the formula (2) given hereinabove. Therefore the steel pipe has a coarse austenite grain and the toughness thereof deteriorated.

On the other hand, the comparative steel pipes of Test Nos. 22 to 24, although the steels D, F and G used have the chemical compositions specified in the present invention, cannot accomplish excellent SSC resistance and excellent toughness simultaneously since the production conditions are outside the conditions regulated by the present invention.

That is to say, in the Test No. 22, the steel billet heating temperature is too high in excess of the upper limit of 1300° C. as specified by the present invention. Therefore, the steel pipe has a coarse austenite grain and the toughness thereof deteriorated.

In the Test No. 23, the final rolling temperature is 1150° C., which is too high in excess of the upper limit specified by the present invention, so that the steel pipe has a coarse austenite grain and the toughness thereof deteriorated.

Further, in the Test No. 24, the complementary heating temperature is 1050° C. which is too high and is in excess of the upper limit specified by the present invention, and so, the steel pipe has a coarse austenite grain and the toughness thereof deteriorated.

In the foregoing, the present invention has been concretely described referring to typical examples thereof, these examples are by no means limitative of the scope of the present invention. It is to be noted that any mode of practice that is not disclosed herein as an example, if it satisfies the requirements of the present invention, falls within the scope of the present invention.

INDUSTRIAL APPLICABILITY

Accordance to the present invention, a seamless steel pipe, having a uniform and fine tempered martensitic microstructure with austenite grains being fine and having a grain size number of not less than 7, and having high strength and excellent toughness as well as a high yield ratio and excellent SSC resistance, can be produced at low cost by efficient means and is capable of realizing energy savings.

What is claimed is:

1. A method for producing a seamless steel pipe having a yield strength of not less than 759 MPa, austenite grains with a grain size number regulated in ASTM E 112 of not less than 7.2 and a critical stress of 90% or more of the actual yield strength in accordance with the SSC resistance test by the NACE-TM-0177-A-96 method, which comprises the steps of making a pipe by heating a steel billet, which has a chemical composition on the mass percent basis, C: 0.15 to 0.20%, Si: not less than 0.01% to less than 0.15%, Mn: 0.05 to 1.0%, Cr: 0.05 to 1.5%, Mo: 0.05 to 1.0%, Al: not more than 0.10%, V: 0.01 to 0.2%, Ti: 0.002 to 0.03%, B: 0.0003 to 0.005% and N: 0.002 to 0.01%, under the provision that the following formulas (1) and (2) are satisfied, with the balance being Fe and impurities, wherein the content of P is not more than 0.025%, the content of S is not more than 0.010% and the content of Nb is less than 0.0004% among the impurities, to a temperature of 1000 to 1250° C. followed by pipe-making rolling at a final rolling temperature adjusted to 900 to 1050° C., and then quenching the resulting steel pipe directly from a temperature not lower than the $Ar_3$ transformation point followed by tempering at a temperature range from 600° C. to the $Ac_1$ transformation point, or instead of the above after the said pipe-making rolling, complementarily heating the resulting steel pipe in a temperature range from the $Ac_3$ transformation point to 1000° C. in-line and then quenching it from a temperature not lower than the $Ar_3$ transformation point followed by tempering at a temperature range from 600° C. to the $Ac_1$ transformation point:

$$C+(Mn/6)+(Cr/5)+(Mo/3)\geqq 0.43 \quad (1),$$

$$Ti\times N<0.0002-0.0006\times Si \quad (2),$$

wherein C, Mn, Cr, Mo, Ti, N and Si in the above formulas (1) and (2) represent the mass percent of the respective elements.

2. A method for producing a seamless steel pipe having a yield strength of not less than 759 MPa, austenite grains with a grain size number regulated in ASTM E 112 of not less than 7.2 and a critical stress of 90% or more of the actual yield strength in accordance with the SSC resistance test by the NACE-TM-0177-A-96 method, which comprises the steps of making a pipe by heating a steel billet, which has a chemical composition on the mass percent basis, C: 0.15 to 0.20%, Si: not less than 0.01% to less than 0.15%, Mn: 0.05 to 1.0%, Cr: 0.05 to 1.5%, Mo: 0.05 to 1.0%, Al: not more than 0.10%, V: 0.01 to 0.2%, Ti: 0.002 to 0.03%, B: 0.0003 to 0.005% and N: 0.002 to 0.01% and, further, one or more elements selected from among Ca: 0.0003 to 0.01%, Mg: 0.0003 to 0.01% and REM: 0.0003 to 0.01%, under the provision that the following formulas (1) and (2) are satisfied, with the balance being Fe and impurities, wherein the content of P is not more than 0.025%, the content of S is not more than 0.010% and the content of Nb is less than 0.0004% among the impurities, to a temperature of 1000 to 1250° C. followed by pipe-making rolling at a final rolling temperature adjusted to 900 to 1050° C., and then quenching the resulting steel pipe directly from a temperature not lower than the $Ar_3$ transformation point followed by tempering at a temperature range from 600° C. to the $Ac_1$ transformation point, or instead of the above after the said pipe-making rolling, complementarily heating the resulting steel pipe in a temperature range from the $Ac_3$ transformation point to 1000° C. in-line and then quenching it from a temperature not lower than the $Ar_3$ transformation point followed by tempering at a temperature range from 600° C. to the $Ac_1$ transformation point:

$$C+(Mn/6)+(Cr/5)+(Mo/3)\geqq 0.43 \quad (1),$$

$$Ti\times N<0.0002-0.0006\times Si \quad (2),$$

wherein C, Mn, Cr, Mo, Ti, N and Si in the above formulas (1) and (2) represent the mass percent of the respective elements.

* * * * *